US010426194B2

(12) United States Patent
Nakano et al.

(10) Patent No.: US 10,426,194 B2
(45) Date of Patent: Oct. 1, 2019

(54) FLAVOR INHALER AND INSIDE HOLDING MEMBER

(71) Applicant: JAPAN TOBACCO INC., Tokyo (JP)

(72) Inventors: Takuma Nakano, Tokyo (JP); Manabu Takeuchi, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 149 days.

(21) Appl. No.: 15/715,430

(22) Filed: Sep. 26, 2017

(65) Prior Publication Data

US 2018/0014570 A1 Jan. 18, 2018

Related U.S. Application Data

(63) Continuation of application No. PCT/JP2015/060785, filed on Apr. 6, 2015.

(51) Int. Cl.
*A24F 13/00* (2006.01)
*A24F 17/00* (2006.01)
(Continued)

(52) U.S. Cl.
CPC ..... *A24F 47/006* (2013.01); *A24F 47/00* (2013.01); *A24F 47/004* (2013.01)

(58) Field of Classification Search
CPC ..... A24F 47/00; A24F 47/002; A24F 47/004; A24F 4/006; A24F 47/008; A24B 15/165
(Continued)

(56) References Cited

U.S. PATENT DOCUMENTS 5,027,837 A * 7/1991 Clearman ..... A24F 47/004 131/194
5,159,940 A 11/1992 Hayward et al.
(Continued)

FOREIGN PATENT DOCUMENTS

JP 2-84166 A 3/1990
JP 5-103836 A 4/1993
(Continued)

OTHER PUBLICATIONS

Extended European Search Report, dated Oct. 18, 2018, for European Application No. 15888427.0.
(Continued)

*Primary Examiner* — Hae Moon Hyeon
(74) *Attorney, Agent, or Firm* — Birch, Stewart, Kolasch & Birch, LLP

(57) ABSTRACT

A flavor inhaler includes a cylindrical holding member having a second side wall; a combustion heat source; a flavor source; an inside holding member that retains at least the flavor source and has a first side wall; and an introduction port. The second side wall has a through-hole that is fluidly coupled to external air. The flavor inhaler further includes a first flow path connecting the through-hole and the introduction port each other and a second flow path connecting the flavor source and a suction port. A flow-path forming member is formed such that a length of a flavor source outer perimeter segment that is a section corresponding an outer perimeter of the flavor source, in the first flow path, is longer than a shortest length connecting the introduction port and a location where fluid flows into the flavor source outer perimeter segment.

21 Claims, 13 Drawing Sheets

(51) Int. Cl.
*A24F 25/00* (2006.01)
*A24F 47/00* (2006.01)

(58) Field of Classification Search
USPC ..... 131/328, 329
See application file for complete search history.

(56) References Cited

U.S. PATENT DOCUMENTS

| | | | | |
|---|---|---|---|---|
| 5,190,060 | A | 3/1993 | Gerding et al. | |
| 7,415,982 | B1 | 8/2008 | Sheridan | |
| 2014/0305448 | A1 | 10/2014 | Zuber et al. | |
| 2016/0143355 | A1* | 5/2016 | Borges | A24F 47/006 131/329 |
| 2017/0055578 | A1* | 3/2017 | Oda | A24B 15/16 |
| 2017/0251719 | A1* | 9/2017 | Cyphert | A24F 1/00 |
| 2018/0014571 | A1* | 1/2018 | Nakano | A24F 47/006 |
| 2018/0020735 | A1* | 1/2018 | Bilat | A24F 47/008 131/328 |
| 2018/0027873 | A1* | 2/2018 | Nakano | A24F 47/006 |
| 2018/0199618 | A1* | 7/2018 | Fuisz | A24B 15/32 |
| 2019/0059450 | A1* | 2/2019 | Akiyama | A24B 15/165 |

FOREIGN PATENT DOCUMENTS

| | | | |
|---|---|---|---|
| JP | 2015-503335 | A | 2/2015 |
| WO | WO 2013/120854 | A1 | 8/2013 |
| WO | WO 2013/120855 | A1 | 8/2013 |
| WO | WO-2014/013054 | A2 | 1/2014 |

OTHER PUBLICATIONS

International Search Report, issued in PCT/JP2015/060785 (PCT/ISA/210), dated Jun. 30, 2015.

* cited by examiner

FLAVOR INHALER AND INSIDE HOLDING MEMBER

CROSS REFERENCE TO RELATED APPLICATIONS

This application is a Continuation of PCT International Application No. PCT/JP2015/060785, filed on Apr. 6, 2015, the entire contents of which are hereby expressly incorporated by reference into the present application.

TECHNICAL FIELD

The present invention relates to a flavor inhaler extending from an ignition end toward a non-ignition end, and an inside holding member that is used for the flavor inhaler.

BACKGROUND ART

A flavor inhaler (smoking article), by which flavor is enjoyed without combusting a flavor source such as tobacco, has been proposed instead of a cigarette. Patent Literature 1 discloses a flavor inhaler including a combustion heat source and an aerosol generation source. The combustion heat source is provided at an ignition end of the flavor inhaler. The aerosol generation source is provided on a non-ignition end side from the combustion heat source. The aerosol generation source generates an aerosol in accordance with heat generated by the combustion heat source.

CITATION LIST

Patent Literature

Patent Literature 1: WO 2013/120855

SUMMARY

A first feature is summarized as a flavor inhaler comprising: a cylindrical holding member extending from an ignition end to a non-ignition end; a combustion heat source provided at the ignition end; a flavor source provided on the non-ignition end side with respect to the combustion heat source; an inside holding member that is provided into the cylindrical holding member, and retains at least the flavor source; and an introduction port that introduces air to the flavor source, wherein the inside holding member has a first side wall having a cylindrical shape to surround at least a part of the flavor source; the cylindrical holding member has a second side wall having a cylindrical shape to surround the first side wall; the second side wall has a through-hole that is fluidly coupled to external air; there are provided a first flow path and the second side wall, the first flow path connecting the through-hole and the introduction port each other and passing between the first side wall and the second side wall, the second flow path connecting the flavor source and a suction port to suck flavor generated at the flavor source; and a flow-path forming member is formed such that a length of a flavor source outer perimeter segment that is a section corresponding an outer perimeter of the flavor source, in the first flow path, is longer than a shortest length connecting the introduction port and a location where fluid flows into the flavor source outer perimeter segment. A part of the inside holding member provided in the cylindrical holding member may extend outside of the cylindrical holding member. The "introduction port" is a concept that includes not only a hole formed on the cylindrical first side wall, but also an opening at an end part of the cylindrical first side wall. Therefore, the "introduction port" may be formed from a gap between the inside holding member and the combustion heat source.

A second feature is summarized as a the flavor inhaler according to the first feature, wherein a fluid resistance of a path passing the flavor source is smaller than a fluid resistance of a path not passing the flavor source, in paths connecting the first flow path and the second flow path.

A third feature is summarized as the flavor inhaler according to the first feature or the second feature, wherein an opening on the ignition end side of the cylindrical holding member is closed.

A fourth feature is summarized as the flavor inhaler according to any one of the first feature to the third feature, wherein the through-hole is provided on the ignition end side from an end part of the non-ignition end side of the flavor source.

A fifth feature is summarized as the flavor inhaler according to any one of the first feature to the fourth feature, wherein the introduction port is provided on the ignition end side from the through-hole, and the first flow path is provided only on the ignition end side from the end part on the non-ignition end side of the flavor source.

A sixth feature is summarized as the flavor inhaler according to any one of the first feature to the fifth feature, wherein the second flow path has a cavity that diffuses flavor.

A seventh feature is summarized as the flavor inhaler according to any one of the first feature to the sixth feature, wherein the flow-path forming member has at least one member provided between the first side wall and the second side wall.

An eighth feature is summarized as the flavor inhaler according to any one of the first feature to the seventh feature, wherein the flow-path forming member includes a spiral member.

A ninth feature is summarized as the flavor inhaler according to any one of the first feature to the eighth feature, wherein the flow-path forming member includes a spiral member wound around the first side wall.

A tenth feature is summarized as the flavor inhaler according to any one of the first feature to the eighth feature, wherein the flow-path forming member includes a member that has an opened portion opened at least at one point and that extends along a circumferential direction of the first side wall, and the opened portion at least at one point is displaced in the circumferential direction with respect to at least either of the through-hole and the introduction port.

A eleventh feature is summarized as the flavor inhaler according to any one of the first feature to the fourth feature, wherein the flow-path forming member has a protrusion or a groove integrally formed on an outer surface of the first side wall or on an inner surface of the second side wall. The protrusion or the groove may be formed so that a flow path is formed between the first side wall and the second side wall.

A twelfth feature is summarized as the flavor inhaler according to any one of the first feature to the fourth feature, wherein the flow-path forming member has a protrusion or a groove integrally formed on an outer surface of the first side wall or on an inner surface of the second side wall.

A thirteenth feature is summarized as the flavor inhaler according to any one of the first feature to the twelfth feature, further comprising a separator that divides the first flow path and the suction port. The separator may or may not completely cut off between the first flow path and the second flow path. When the separator does not completely cut off between the first flow path and the second flow path, the separator only needs to be configured such that a fluid resistance of a path passing the flavor source is smaller than a fluid resistance of a path not passing the flavor source, in paths connecting the first flow path and the second flow path.

A fourteenth feature is summarized as the flavor inhaler according to any one of the thirteenth feature, wherein the separator extends in a circumferential direction of the first side wall, between the first side wall and the second side wall.

A fifteenth feature is summarized as the flavor inhaler according to any one of the first feature to the fourteenth feature, wherein the inside holding member is configured to retain the combustion heat source and the flavor source; the inside holding member has a hook section that protrudes toward inside the first side wall and locks the combustion heat source; and the introduction port is formed on the non-ignition end side with respect to a contact point of the hook section and the combustion heat source, of the first side wall.

A sixteenth feature is summarized as the flavor inhaler according to the fifteenth feature, wherein the introduction port is adjacent to the non-ignition end side with respect to the contact point of the hook section and the combustion heat source.

A seventeenth feature is summarized as the flavor inhaler according to any one of the first feature to the sixteenth feature, wherein the first side wall has a tapered shape that enters into inside of the first side wall toward the non-ignition end side from the ignition end side.

A eighteenth feature is summarized as the flavor inhaler according to any one of the first feature to the seventeenth feature, wherein the inside holding member has a bottom part that supports an end surface on the non-ignition end side of the flavor source; an air hole is formed at a section on the non-ignition end side of the inside holding member; and the introduction port is provided on the ignition end side from the flavor source or around the flavor source. The flavor source may be composed by a plurality of granules. In this case, the end face on the non-ignition end side of the flavor source means a surface that is formed by a part, of the plurality of granules, arranged at the most non-ignition end side, which is a surface in contact with the bottom part of the inside holding member.

A nineteenth feature is summarized as the flavor inhaler according to any one of the first feature to the eighteenth feature, wherein the second side wall has a thermal conductor that covers at least a part of the first side wall and that extends on the non-ignition end side from the first side wall.

A twentieth feature is summarized as the flavor inhaler according to any one of the first feature to the nineteenth feature, wherein the inside holding member is integrally formed by a thermal conductor.

A twenty-first feature is summarized as an inside holding member that is used for a flavor inhaler including a combustion heat source and a flavor source and that retains at least the flavor source, the inside holding member comprising: a first side wall having a cylindrical shape to surround at least a part of the flavor source; an introduction port that introduces air into inside of the first side wall; and a flow-path forming member formed such that, when the inside holding member is provided in a cylindrical holding member including a second side wall having a through-hole that is fluidly coupled to external air, a length of a flavor source outer perimeter segment that is a section corresponding to an outer perimeter of the flavor source, in a first flow path connecting the through-hole and the introduction port and passing between the first side wall and the second side wall, is longer than a shortest length connecting the introduction port and a location where fluid flows into the flavor source outer perimeter segment.

DESCRIPTION OF EMBODIMENTS

Figure 1:
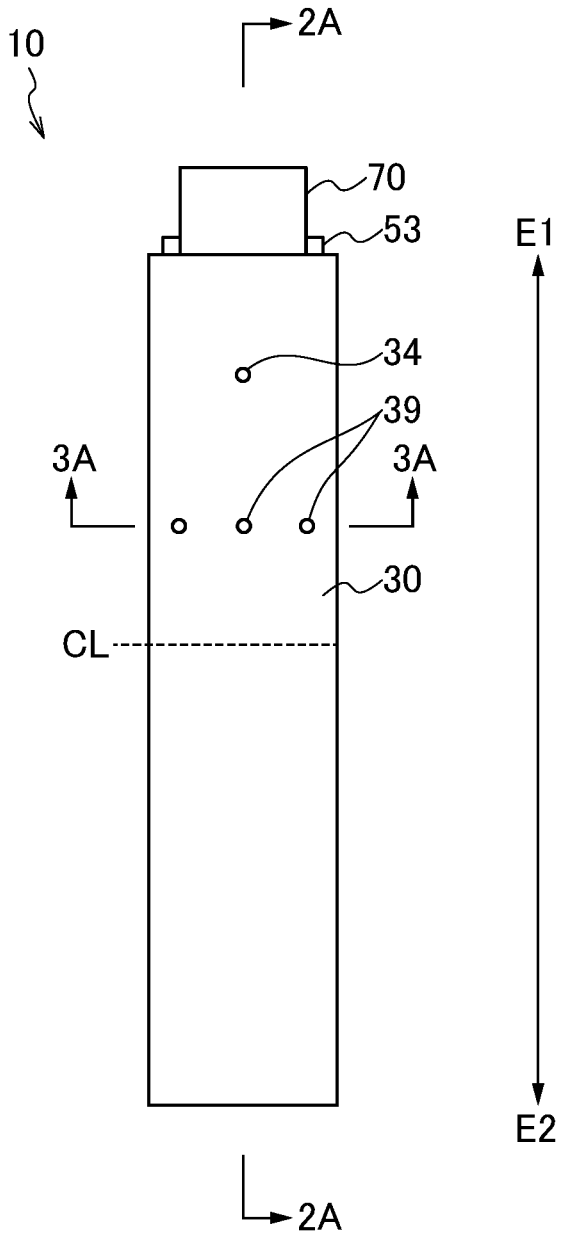
FIG. 1 is a side view of a flavor inhaler according to a first embodiment.

Embodiments are described below. In the description of the drawings below, same or similar reference numerals are given to same or similar parts. It should be noted that, however, the drawings are schematic, in which a ratio or the like of each dimension may differ from that in actuality.

Therefore, a specific dimension or the like should be determined in consideration of the following description. Naturally, even between the drawings, there is included a part in which a relation or a ratio of dimensions of those may differ from each other.

[Summary of Embodiments]

A flavor inhaler according to an embodiment has: a cylindrical holding member extending from an ignition end to a non-ignition end; a combustion heat source provided at the ignition end; a flavor source provided on the non-ignition end side with respect to the combustion heat source; an inside holding member that is provided in the cylindrical holding member, and retains at least the flavor source; and an introduction port that introduces air to the flavor source. In the flavor inhaler, the inside holding member has a first side wall having a cylindrical shape to surround at least a part of the flavor source; the cylindrical holding member has a second side wall having a cylindrical shape to surround the first side wall; the second side wall has a through-hole that is fluidly coupled to external air; there are provided a first flow path connecting the through-hole and the introduction port and passing between the first side wall and the second side wall, and a second flow path connecting the flavor source and a suction port where flavor generated at the flavor source is sucked; and there is provided a flow-path forming member formed such that a length of a flavor source outer perimeter segment, which is a section corresponding an outer perimeter of the flavor source, in the first flow path, is longer than a shortest length connecting the introduction port and a location where fluid flows into the flavor source outer perimeter segment.

An inside holding member according to an embodiment is an inside holding member that is used for a flavor inhaler including a combustion heat source and a flavor source, and retains at least the flavor source. The inside holding member has: a cylindrical first side wall to surround at least a part of the flavor source; an introduction port that introduces air into inside of the first side wall; and a flow-path forming member formed such that, when the inside holding member is provided in the cylindrical holding member including the second side wall having a through-hole that is fluidly coupled to external air, a length of a flavor source outer perimeter segment, which is a section corresponding to an outer perimeter of the flavor source, in a first flow path connecting the through-hole and the introduction port and passing between the first side wall and a second side wall, is longer than a shortest length connecting the introduction port and a location where fluid flows into the flavor source outer perimeter segment.

In the embodiment, the flow-path forming member is formed such that the length of the flavor source outer perimeter segment, which is the section corresponding to the outer perimeter of the flavor source, in the first flow path, is longer than the shortest length connecting the introduction port and the location where fluid flows into the flavor source outer perimeter segment. This can achieve a longer length of the first flow path, namely, a longer flow-path length from the through-hole to the flavor source. Therefore, when a user is not performing a puff action, it is possible to prevent flavor from flowing out from the through-hole through the first flow path from the flavor source.

[First Embodiment]

(Flavor Inhaler)

Figure 2:
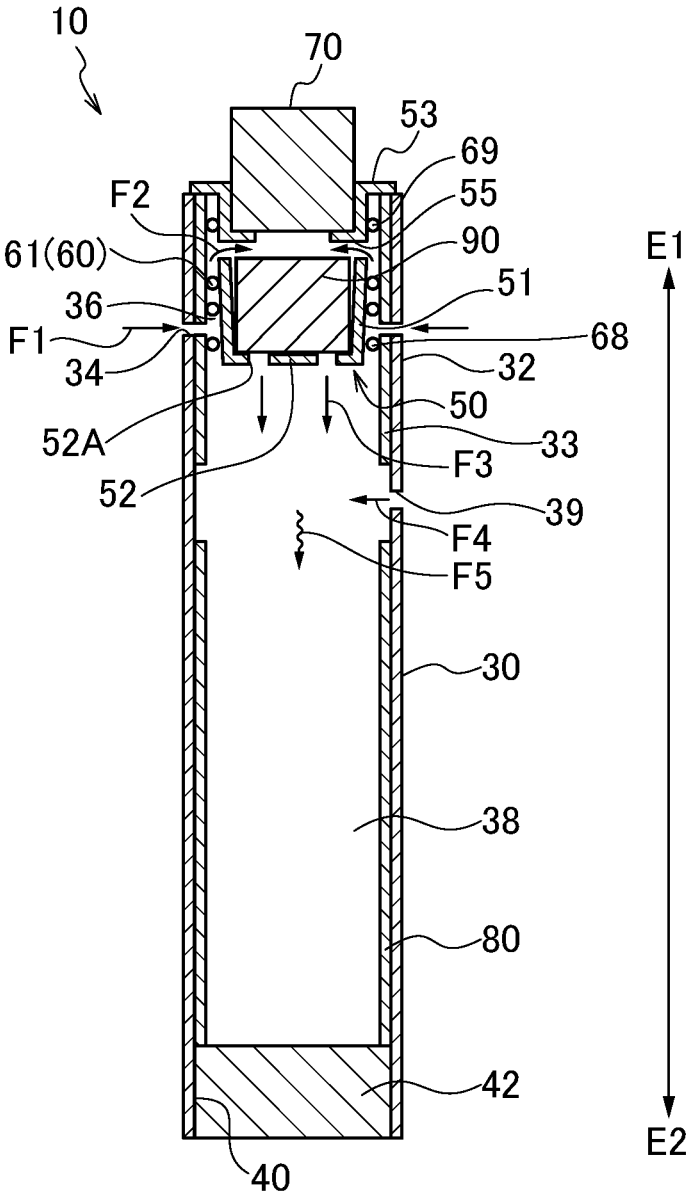
FIG. 2 is a cross-sectional view of the flavor inhaler along 2A-2A line in FIG. 1.
Figure 3:
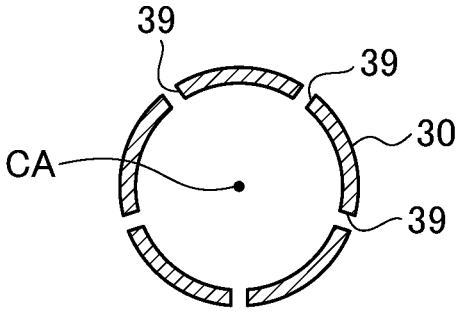
FIG. 3 is a cross-sectional view of the flavor inhaler along 3A-3A line in FIG. 1.

A flavor inhaler according to a first embodiment is described below. FIG. 1 is a side view of the flavor inhaler 10 according to the first embodiment. FIG. 2 is a cross-sectional view of the flavor inhaler 10 along 2A-2A line in FIG. 1. FIG. 3 is a cross-sectional view of the flavor inhaler 10 along 3A-3A line in FIG. 1. The flavor inhaler 10 has a cylindrical holding member 30, an inside holding member 50, a combustion heat source 70, and a flavor source 90.

The cylindrical holding member 30 extends from an ignition end E1 toward a non-ignition end E2. The ignition end E1 is an end on a side provided with the combustion heat source 70. Non-ignition end E2 is an end on a side provided with a suction port 40. The suction port 40 is positioned where a user holds in the mouth for sucking a flavor. The cylindrical holding member 30 may have, for example, a cylindrical shape or a rectangular cylindrical shape. An opening on the ignition end E1 side of the cylindrical holding member 30 is preferably closed. In this embodiment, at least the inside holding member 50 and the combustion heat source 70 close the opening on the ignition end E1 side of the cylindrical holding member 30. Thus, the flavor inhaler 10 is preferably configured such that gas does not enter into the cylindrical holding member 30 from the opening on the ignition end E1 side of the cylindrical holding member 30.

The inside holding member 50 is provided in the cylindrical holding member 30. However, a part of the inside holding member 50 may extend outside of the cylindrical holding member 30. The inside holding member 50 retains at least a part of the combustion heat source 70 and at least a part of the flavor source 90. The inside holding member 50 has the first side wall 51 in a cylindrical shape and an introduction port 55. The first side wall 51 surrounds at least a part of the flavor source 90 and at least a part of the combustion heat source 70. Alternatively, the first side wall 51 may surround at least a part of the flavor source 90 without surrounding the combustion heat source 70. The introduction port 55 is provided so as to introduce air to the flavor source 90 in the first side wall 51. The introduction port 55 may be formed from a hole formed on the first side wall 51.

The combustion heat source 70 is provided on the ignition end E1 side of the cylindrical holding member 30. The combustion heat source 70 is composed from a combustible material. The combustible material is, for example, a mixture including a carbon material, an incombustible additive, a binder (an organic binder or an inorganic binder), and water. As the carbon material, it is preferable to use a material from which volatile impurities have been removed by a heat treatment or the like. When a total weight of the combustion heat source 70 is 100 wt. %, the combustion heat source 70 preferably includes a carbonaceous material in a range of 30 wt. % to 70 wt. %, more preferably includes the carbonaceous material in a range of 35 wt. % to 45 wt. %.

The combustion heat source 70 is designed such that a part on the ignition end E1 side is burned, but an end part on a non-ignition end E2 side is not burned. Namely, the end part on the non-ignition end E2 side of the combustion heat source 70 forms a non-combustion part, while other part of the combustion heat source 70 forms a combustion part.

The flavor source 90 is provided inside the cylindrical holding member 30, on the non-ignition end E2 side from the combustion heat source 70. The flavor source 90 may be adjacent to the combustion heat source 70. The flavor source 90 is configured to generate flavor without combusting. To be more precise, the flavor source 90 generates flavor by heating with the combustion heat source 70.

As the flavor source 90, for example, a tobacco material can be used. In such a case, the flavor source 90 may include general cut tobacco that is used for cigarettes (paper rolled tobacco), and may include granular tobacco that is used for snuff tobacco. The flavor source 90 may include glycerin and/or propylene glycol, in addition to the tobacco material. The flavor source 90 may include a flavoring agent.

The cylindrical holding member 30 has a second side wall 32 having a cylindrical shape to surround the first side wall 51 of the inside holding member 50. The second side wall 32 may extend long from the ignition end E1 side toward the non-ignition end E2 side. The second side wall 32 may include, for example, a paper tube formed by deforming a rectangular cardboard into a cylindrical shape.

At least the first side wall 51 of the inside holding member 50 may be formed by a thermal conductor. Additionally, it is preferable that the inside holding member 50 is integrally formed by the thermal conductor. Heat conductivity of this thermal conductor at normal temperature is preferably equal to or more than 10 W/(m·K) in a direction along the ignition end E1 to the non-ignition end E2. As the thermal conductor, for example, stainless steel can be used. As the stainless steel, for example, SUS430 may be used. When the inside holding member 50 is made from stainless steel, a thickness of the first side wall 51 of the inside holding member 50 is preferably 0.1 mm or less.

The second side wall 32 of the cylindrical holding member 30 may include a first thermal conductor 33 facing the inside holding member 50. The first thermal conductor 33 is arranged so as to cover at least a part of at least the first side wall 51 of the inside holding member 50. The first thermal conductor 33 does not need to be directly in contact with the combustion heat source 70.

The first thermal conductor 33 promotes the heat conduction from the combustion heat source 70 to the flavor source 90. The first thermal conductor 33 preferably extends to the non-ignition end E2 side from an end face on the non-ignition end E2 side of the inside holding member 50. The first thermal conductor 33 is preferably formed from a metal material excellent in heat conductivity. Heat conductivity of the first thermal conductor 33 is preferably higher than heat conductivity of the first side wall 51. For example, the first thermal conductor 33 is formed from aluminum.

The second side wall 32 of the cylindrical holding member 30 has a through-hole 34 that is fluidly coupled to external air. The through-hole 34 may be provided on the ignition end E1 side from an end part on the non-ignition end E2 side of the flavor source 90.

At least between the first side wall 51 and the second side wall 32, a flow-path forming member 60 is provided. The flow-path forming member 60 defines a first flow path 36 inside the cylindrical holding member 30, for allowing external air to flow to the flavor source 90. The flow-path forming member 60 may also be formed from a member that is separate from the first side wall 51 and the second side wall 32. Alternatively, the flow-path forming member 60 may also be formed from a member that is integrally formed on the first side wall 51 or the second side wall 32. The first flow path 36 connects the through-hole 34 of the second side wall 32 and the introduction port 55 of the inside holding member 50, and passes between the first side wall 51 and the second side wall 32.

The inside holding member 50 may also have a thermal conductor (not shown) provided on an outer surface of the first side wall 51. This thermal conductor may be arranged so as to cover at least a part of at least the first side wall 51 of the inside holding member 50, as with the first thermal conductor 33. This thermal conductor promotes heat conduction from the combustion heat source 70 to the flavor source 90. This thermal conductor is preferably formed from a metal material excellent in heat conductivity, for example, formed from aluminum. When the inside holding member 50 has a thermal conductor adjacent to the outer surface of the first side wall 51, the first thermal conductor 33 does not need to be provided. In this case, the flow-path forming member 60 may be provided between the second side wall 32 and the thermal conductor on the outer surface of the first side wall 51.

In the cylindrical holding member 30, there is provided a second flow path 38 for allowing flavor generated at the flavor source 90 to flow to the suction port 40. The second flow path 38 connects the flavor source 90 and the suction port 40 where the flavor generated at the flavor source 90 is sucked. The introduction port 55 of the inside holding member 50 may be provided on the ignition end E1 side from the through-hole 34 of the cylindrical holding member 30. Additionally, the first flow path 36 is preferably provided only on the ignition end E1 side from the end part on the non-ignition end E2 side of the flavor source 90.

During a puff action of a user, external air enters into the first flow path 36 from the through-hole 34 (arrow F1 in FIG. 2). Then, the external air reaches the flavor source 90 through the introduction port 55 (arrow F2 in FIG. 2). The external air passing through the first flow path 36 reaches the flavor source 90 without coming into contact with the combustion part of the combustion heat source 70. The air having reached the flavor source 90 goes to the suction port 40 by passing through the second flow path 38, along with the flavor (arrows F3 and F5 in FIG. 2). Since the flavor source 90 is heated by the combustion heat source 70, a temperature of the gas passing the flavor source 90 to flow into the second flow path 38 is high.

The cylindrical holding member 30 has a hole 39 (hereinafter referred to as a "ventilation hole") that allows external air to directly flow into the second flow path 38. Here, "directly flow" means that external air flows into the second flow path 38 without passing the flavor source 90.

The ventilation hole 39 may be formed such that gas flows in a crossing direction to an extending direction of the second flow path 38 (arrow F4 in FIG. 2). For example, the ventilation hole 39 may be formed such that gas flows in toward a center axis of the second flow path 38, along a direction substantially orthogonal to the extending direction of the second flow path 38. It is preferable that a plurality of the ventilation holes 39 are provided on a circumferential direction of the cylindrical holding member 30 at intervals. In this case, the intervals between the ventilation holes 39 may be constant. The ventilation hole 39 may be provided on an opposite side to the suction port 40, with respect to a center CL of the cylindrical holding member 30 in the extending direction of the second flow path 38. The ventilation hole 39 is preferably provided between the first thermal conductor 33 and a cooling layer 80.

Any one of the plurality of ventilation holes 39 is preferably arranged at a position not opposed to another one among the plurality of ventilation holes 39, and is more preferably arranged at a position displaced from a straight line connecting another one among the plurality of ventilation holes 39 and a center axis CA of the cylindrical holding member 30 (see FIG. 3). In this case, each of the ventilation holes 39 is not arranged on an opposite side to each of the ventilation holes 39 across the center axis CA of the cylindrical holding member 30. Additionally, the plurality of ventilation holes 39 are preferably arranged at same positions to each other in a direction along the center axis CA of the cylindrical holding member 30. However, the plurality of ventilation holes 39 may also be arranged to be displaced to each other in a direction along the center axis CA of the cylindrical holding member 30.

The cooling layer 80 is a layer that cools flavor generated at the flavor source 90. The cooling layer 80 is provided on an inner surface of the cylindrical holding member 30 to face the second flow path 38. The cooling layer 80 preferably surrounds the second flow path 38, in at least a part of section of the second flow path 38. The cooling layer 80 is preferably provided only downstream of the flavor source 90. The cooling layer 80 preferably has a thickness not to remarkably increase a fluid resistance of the second flow path 38. Depending on a diameter of the second flow path 38, the thickness of the cooling layer 80 is, for example, preferably 5 μm or more to 500 μm or less. Further, in a cross section vertical to the center axis CA of the cylindrical holding member 30, a ratio of a cross-sectional area of the cooling layer 80 with respect to a cross-sectional area inside an inner wall of the cylindrical holding member 30 is preferably 0.2% or more to 45% or less, more preferably 0.5% or more to 5% or less. For example, in the cross section vertical to the center axis CA of the cylindrical holding member 30, an outer diameter of the cylindrical holding member 30 may be 5 mm to 8 mm, the thickness of the cylindrical holding member 30 may be 0.15 mm to 0.5 mm, and the thickness of the cooling layer 80 may be 0.05 mm to 0.5 mm.

In the first embodiment, the cooling layer 80 is provided only downstream of the ventilation holes 39. In other words, the cooling layer 80 does not reach the upstream side from the ventilation holes 39. Alternatively, a part of the cooling layer 80 may reach the upstream side of the ventilation holes 39. Namely, only at least a part of the cooling layer 80 needs to be provided downstream of the ventilation holes 39.

The cooling layer 80 preferably has a length equal to or longer than a half length of the second flow path 38 in the extending direction of the second flow path 38. The cooling layer 80 is preferably separated from the first thermal conductor 33 that composes the cylindrical holding member 30.

The cooling layer 80 preferably defines a single channel to be passed with the flavor, in the cylindrical holding member 30. More preferably, inside of the cooling layer 80 is hollow. Here, "inside of the cooling layer 80 is hollow" means that any member is not present inside the cooling layer 80, other than a filter 42 provided to the suction port 40. In this case, a volume of a cavity portion in the second flow path 38 can be larger. In this embodiment, the cooling layer 80 defines the single channel in the cylindrical holding member 30, and inside of the cooling layer 80 is hollow.

In the first embodiment, inside of the cooling layer 80 is hollow. Alternatively, inside the cooling layer 80 may be provided with any member to an extent not to significantly increase a flow-path resistance of the second flow path 38. For example, a cylindrical member may be provided along the center axis of the second flow path. This cylindrical member may also be provided with another cooling layer on its outer peripheral surface.

The cooling layer 80 may include a second thermal conductor. The second thermal conductor may be metal. As an example, the cooling layer 80 may be formed from a metal pipe. Alternatively, the cooling layer 80 may be formed from a metal-laminated paper including a paper, and a metal layer that is laminated to the paper. As the metal described above, for example, aluminum can be used. Further, instead of these, the cooling layer 80 may also be a layer including polylactic acid (PLA). Furthermore, the cooling layer 80 may be formed from a same material as that of the first thermal conductor 33 that composes the cylindrical holding member 30.

The cooling layer 80 may have a plurality of projections and depressions for increasing a surface area of the cooling layer 80. Such projections and depressions can be formed, for example, by crepe processing of a surface of the cooling layer 80. These projections and depressions allow an increase in a heat-exchange-surface area of the cooling layer 80, without making the cross-sectional area of the second flow path 38 too small.

(Detailed Configuration of Inside Holding Member and Flow-Path Forming Member)

Figure 4:
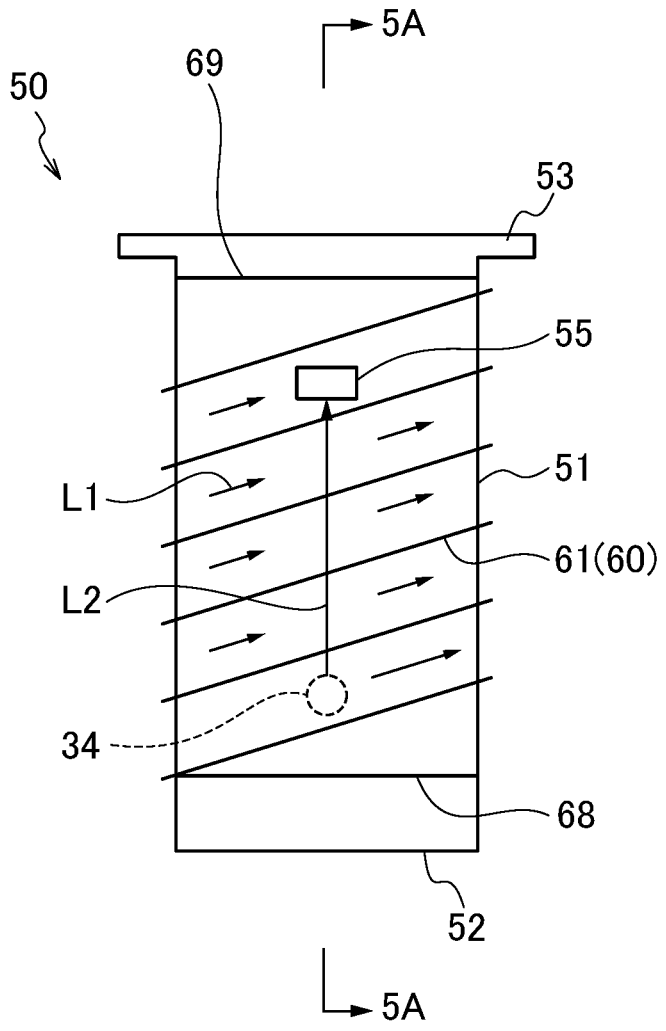
FIG. 4 is a plan view of an inside holding member that is provided in a cylindrical holding member.

A detailed configuration of the inside holding member 50 and the flow-path forming member 60 is described below by using FIGS. 2, 4, and 5. In FIG. 4, a position of the through-hole 34 formed on the second side wall 32 is indicated by a dotted line for convenience. The inside holding member 50 has the first side wall 51 and a hook section 54. The first side wall 51 has a cylindrical shape. The first side wall 51 may have a tapered shape entering inside the first side wall 51, from the ignition end E1 side toward the non-ignition end E2 side.

The hook section 54 has a shape protruding toward inside the inside holding member 50 from an inner surface of the first side wall 51. The hook section 54 locks the combustion heat source 70. In the first embodiment, the hook section 54 locks an end face of the combustion heat source 70. However, a position where the hook section 54 locks is not limited to the end face of the combustion heat source 70.

The hook section 54 is preferably configured by, although not limited to, a pair of the hook sections 54 opposed to each other. The embodiment is not limited to this, and the hook section 54 may be configured by three or more of the hook sections.

The inside holding member 50 has the introduction port 55 that introduces air to the flavor source 90 arranged inside the first side wall 51. The introduction port 55 may be formed on the non-ignition end E2 side with respect to a contact point of the hook section 54 and the combustion heat source 70. Preferably, the introduction port 55 is adjacent to the non-ignition end E2 side with respect to the contact point of the hook section 54 and the combustion heat source 70. More particularly, the hook section 54 may protrude toward inside a first wall part 51 with a part defining an edge of the introduction port 55 of the first wall part 51 as a starting point.

The inside holding member 50 may have a bottom part 52. The bottom part 52 closes one of a pair of openings formed by the first side wall 51. The inside holding member 50 may have a cup shape formed by the first side wall 51 and the bottom part 52. In this case, the inside holding member 50 can contain the flavor source 90. More particularly, the bottom part 52 of the inside holding member 50 can support an end face on the non-ignition end side of the flavor source 90. The flavor source 90 may be composed by a plurality of granules. In this case, the end face on the non-ignition end E2 side of the flavor source 90 means a surface that is formed by a part, of the plurality of granules, arranged at the most non-ignition end E2 side, which is a surface in contact with the bottom part 52 of the inside holding member.

The inside holding member 50 is inserted into the cylindrical holding member 30 in a direction such that the bottom part 52 of the inside holding member 50 is disposed on the non-ignition end E2 side, and the inside holding member 50 is opened toward the ignition end E1 side. The bottom part 52 may be provided with one or more of air holes 52A. Alternatively, the air hole 52A may also be formed on the first side wall 51. The air hole 52A may be formed at a portion on the non-ignition end side E2 of the inside holding member 50. Gas flowing into the flavor source 90 in the first side wall 51 flows into the second flow path 38 through the air hole 52A.

The inside holding member 50 may have a flange 53. The flange 53 has a shape extending outside of the inside holding member 50 from an outer perimeter of the opening of the inside holding member 50. The flange 53 is locked to the outer perimeter of the opening of the holding member 30, in a state where the inside holding member 50 is inserted into the cylindrical holding member 30. Alternatively, the inside holding member 50 may not have the flange 53.

Figure 5:
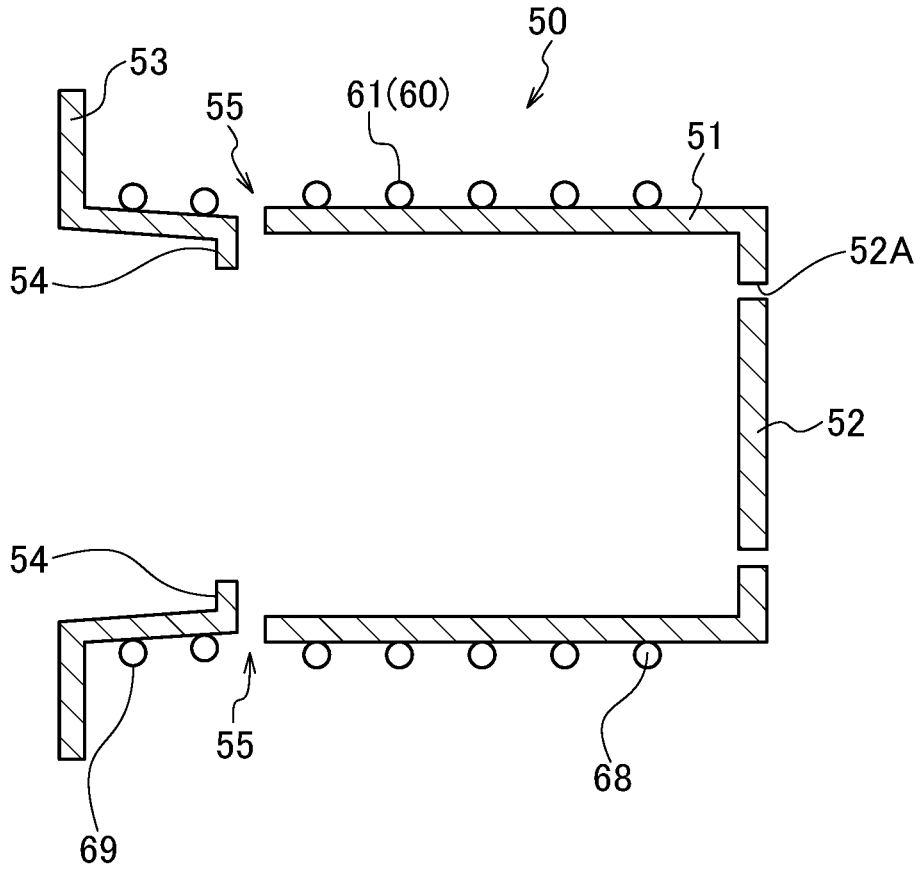
FIG. 5 is a cross-sectional view of the inside holding member along 5A-5A line in FIG. 4.

In an embodiment illustrated in FIGS. 4 and 5, the flow-path forming member 60 includes a spiral member 61. The spiral member 61 is wound around the first side wall 51. Alternatively, the spiral member 61 may be mounted on an inner surface of the second side wall 32. For example, the flow-path forming member 60 may be configured by a metal wire formed into a spiral shape.

The flow-path forming member 60 is formed such that, when the inside holding member 50 is provided in the cylindrical holding member 30 including the second side wall 32, a length of the flavor source outer perimeter segment L1, which is a section corresponding to the outer perimeter of the flavor source 90 in the first flow path 36 connecting the through-hole 34 and the introduction port 55 and passing between the first side wall 51 and the second side wall 32, is longer than a shortest length L2 connecting the introduction port 55 and a location where fluid flows into the flavor source outer perimeter segment L1.

In FIGS. 4 and 5, at least a part of the spiral member 61 is positioned at an area between the through-hole 34 and the introduction port 55. This causes the spiral member 61 to form the flavor source outer perimeter segment L1 having the spiral shape, between the first side wall 51 and the second side wall 32. Consequently, the first flow path 36 is longer than the shortest length L2 between the through-hole 34 and the introduction port 55 when there is no flow-path forming member 60.

The flavor inhaler 10 may have a first separator 68 that separates the first flow path 36 and the suction port 40 (or the second flow path 38). In FIGS. 2, 4, and 5, the first separator 68 is formed by one end part of the spiral member 61. In other words, the one end part of the spiral member 61 is provided between the first side wall 51 and the second side wall 32 on the non-ignition end E2 side from the through-hole 34 of the second side wall 32. The one end part of the spiral member 61 preferably extends in a circumferential direction of the first side wall 51. This causes the one end part of the spiral member 61 as the first separator 68 to prevent a direct flow of gas into the second flow path 38 from the first flow path 36.

However, the first separator 68 does not need to completely cut off between the first flow path 36 and the second flow path 38. In this case, in paths connecting the first flow path 36 with the second flow path 38, a fluid resistance of a path passing the flavor source 90 is preferably smaller than a fluid resistance of a direct path from the first flow path 36 to the second flow path 38. Further, the flavor inhaler may have a plurality of paths connecting the first flow path 36 with the second flow path 38. In this case, in the paths connecting the first flow path 36 with the second flow path 38, the fluid resistance of the path passing the flavor source 90 is preferably smaller than a fluid resistance of another path connecting from the first flow path 36 to the second flow path 38.

The flavor inhaler 10 may have a second separator 69 that prevents leakage of gas from the first flow path 36. The second separator 69 closes the opening on the ignition end E1 side of the cylindrical holding member 30, along with the inside holding member 50 and the combustion heat source 70. In FIGS. 2, 4, and 5, the second separator 69 is formed by another end part of the spiral member 61. In other words, the other end part of the spiral member 61 is provided between the first side wall 51 and the second side wall 32, on the ignition end E1 side from the introduction port 55 of the first side wall 51. The other end part of the spiral member 61 preferably extends in a circumferential direction of the first side wall 51. This causes the other end part of the spiral member 61 as the second separator 69 to prevent leakage of gas from the ignition end E1 side of the first flow path 36. However, the second separator 69 does not need to completely cut off the leakage of gas from the ignition end E1 side of the first flow path 36.

In the above-described embodiment, the separators 68 and 69 are formed from a part of the spiral member 61. Alternatively, the separators 68 and 69 may also be formed from a member separate from the spiral member 61. Moreover, the separators 68 and 69 may also be formed from a member integrally formed on the first side wall 51 or the second side wall 32.

(Operation and Effect)

In an inside holding member 50 and a flavor inhaler 10 according to one embodiment, a flow-path forming member 60 is formed such that, a length of a flavor source outer perimeter segment L1, which is a section corresponding to an outer perimeter of a flavor source 90, in a first flow path 36, is longer than a shortest length L2 connecting an introduction port 55 and a location where fluid flows into the flavor source outer perimeter segment L1. This can achieve a longer length of the first flow path 36, namely, a longer flow-path length from the through-hole 34 to the flavor source 90. Therefore, when a user is not performing a puff action, it is possible to prevent flavor from flowing out from the through-hole 34 through the first flow path 36 from the flavor source 90. This can prevent generation of sidestream smoke that flows out without passing a filter 42 provided at the suction port 40.

Additionally, external air moves over a long distance around the heated flavor source 90, until reaching the flavor source 90 from the through-hole 34. This causes heat transmission or the like to the external air from the heated inside holding member 50, allowing the heated external air to flow into the flavor source 90. On the other hand, the external air may also serve to slightly lower a temperature of the first side wall 51 in the flavor source outer perimeter segment L1. This may prevent over heating of the flavor source 90, which is in contact with the first side wall 51. From a viewpoint of more uniform heating of the flavor source 90, it is preferable to increase the temperature of the external air that is introduced to the flavor source 90, by making the flavor source outer perimeter segment L1 long.

According to one embodiment, a fluid resistance of a path passing a flavor source 90 is smaller than a fluid resistance of a path not passing the flavor source 90, in paths connecting a first flow path 36 and a second flow path 38. This causes most of the external air flowing in from a through-hole 34 during a puff action of a user to reach the flavor source 90 through an introduction port 55 from the first flow path 36, and then the external air flows into the second flow path 38 along with flavor generated at the flavor source 90.

According to one embodiment, an opening on an ignition end E1 side of a cylindrical holding member 30 is closed. This causes external air to be taken into a flavor source 90 mainly through a first flow path 36 from a through-hole 34, during a puff action of a user.

According to one embodiment, a through-hole 34 is provided on an ignition end E1 side from an end part on a non-ignition end E2 side of a flavor source 90. This prevents possibility that a user closes the through-hole 34 with a finger during a puff action.

According to one embodiment, an introduction port 55 is provided on an ignition end E1 side from a through-hole 34, and a first flow path 36 is provided only on the ignition end E1 side from an end part on a non-ignition end E2 side of a flavor source 90. This reduces possibility that a user crushes the first flow path 36 with a finger during a puff action.

According to one embodiment, a second flow path 38 has a cavity that diffuses flavor. This enables diffusion of flavor having passed a flavor source 90, and efficient cooling. According to this embodiment, a first flow path 36 is preferably provided only on an ignition end E1 side from an end part on a non-ignition end E2 side of the flavor source 90. This can increase a volume of the second flow path (cavity) 38 on a downstream side of the flavor source 90 as possible, allowing a further increase in cooling efficiency of gas in the second flow path 38, without particularly increasing an outer diameter of a flavor inhaler.

According to one embodiment, there is provided a first separator 68 that separates a first flow path 36 and a suction port 40. The first separator 68 may extend between a first side wall 51 and a second side wall 32, toward a circumferential direction of the first side wall 51. The first separator 68 causes all or most of the external air flowing in from a through-hole 34 during a puff action of a user to reach a flavor source 90 through an introduction port 55 from the first flow path 36, and then the external air flows into a second flow path 38 along with flavor generated at the flavor source 90.

According to one embodiment, an inside holding member 50 has a hook section 54 that protrudes toward inside a first side wall 51 and locks a combustion heat source 70. An introduction port 55 is formed on a non-ignition end side with respect to a contact point of the hook section 54 and the combustion heat source 70, of the first side wall 51. The hook section 54 enables proper control of an insertion length of the combustion heat source 70, and proper control of a length of the flavor source 90.

According to one embodiment, an introduction port 55 is adjacent to a non-ignition end side with respect to a contact point of a hook section 54 and a combustion heat source 70. Since the hook section 54 and the introduction port 55 are adjacent to each other, the hook section 54 and the introduction port 55 can be formed in a same process. To be more precise, by protruding a part of the first side wall 51 from the first side wall 51, there can be simultaneously formed the hook section 54 capable of locking a combustion heat source 70, and the introduction port 55 adjacent to the hook section 54.

According to one embodiment, a first side wall 51 has a tapered shape entering inside the first side wall 51, from an ignition end E1 side toward a non-ignition end E2 side. This allows a peripheral surface of a combustion heat source 70 and/or a flavor source 90 to be supported by the first side wall 51 having the tapered shape.

According to one embodiment, an inside holding member 50 has a bottom part 52 that supports an end surface on a non-ignition end E2 side of a flavor source 90, and an air hole 52A is formed at a section on the non-ignition end E2 side of the inside holding member 50. Additionally, an introduction port 55 is provided on an ignition end E1 side from the flavor source 90 or around the flavor source 90. The inside holding member 50 is formed into a cup shape having a first side wall 51 and the bottom part 52. This allows the inside holding member 50 to hold the flavor source 90 more surely. Even when, in particular, the flavor source 90 is formed from a plurality of flavor pieces, for example, granular pieces, the inside holding member 50 can support the flavor source 90.

According to one embodiment, a second side wall 32 covers at least a part of a first side wall 51, and has a thermal conductor 33 extending on a non-ignition end E2 side from the first side wall 51. The thermal conductor 33 allows heat generated at a combustion heat source 70 to be efficiently transmitted to a flavor source 90. Moreover, since the thermal conductor 33 extends on the non-ignition end E2 side from the first side wall 51, heat of the thermal conductor 33 is released at a tip part protruding from the first side wall 51. This prevents over heating of the first side wall 51. The thermal conductor 33 is preferably formed from a material having higher heat conductivity than that of the first side wall 51. The first side wall 51 is preferably formed from a material having a higher corrosion resistance against a carbon material than that of the thermal conductor 33.

According to one embodiment, an inside holding member 50 is integrally formed by a thermal conductor. This allows the inside holding member 50 to perform a function of transmitting heat generated at a combustion heat source 70 to a flavor source 90.

[First Modified Example[

Figure 6:
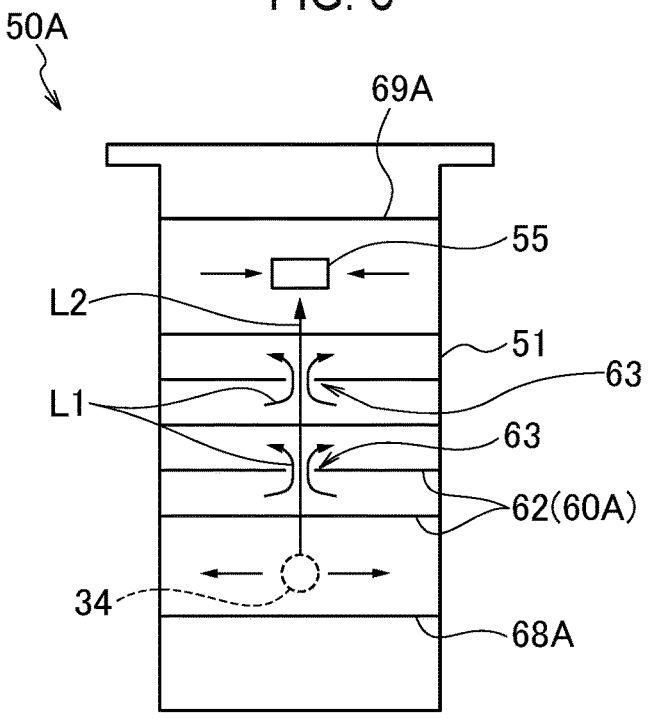
FIG. 6 is a plan view of an inside holding member and a flow-path forming member according to a first modified example.
Figure 7:
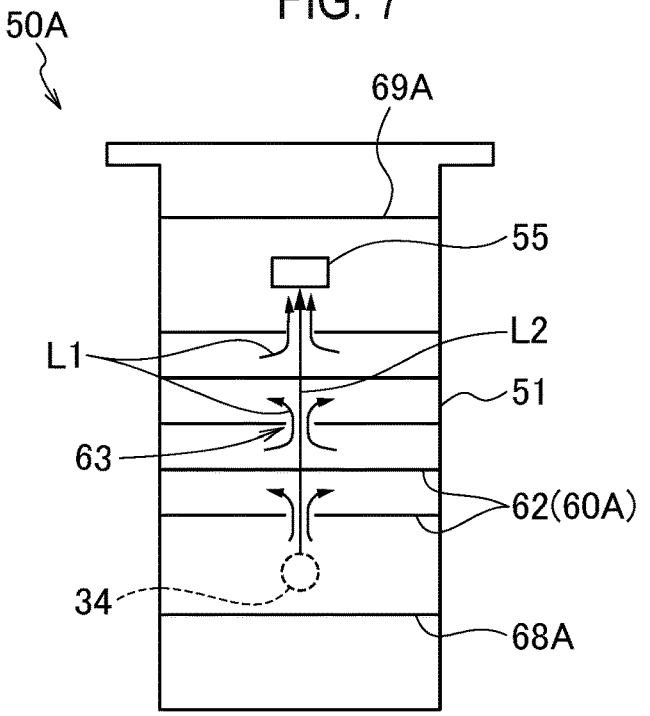
FIG. 7 is a plan view of the inside holding member and the flow-path forming member on opposite side to that in FIG. 6, according to the first modified example.

The inside holding member and a flow-path forming member according to a first modified example are described below with reference to FIGS. 6 and 7. FIG. 6 is a plan view of an inside holding member 50A and a flow-path forming member 60A according to the first modified example. FIG. 7 is a plan view of the inside holding member 50A and the flow-path forming member 60A on an opposite side to that in FIG. 6, according to the first modified example. In FIGS. 6 and 7, a position of a through-hole 34 formed on a second side wall 32 is indicated by a dotted line for convenience.

A configuration of the inside holding member 50A is same as that illustrated in FIGS. 4 and 5. The flow-path forming member 60A has at least one member provided between a first side wall 51 and the second side wall 32.

In the first modified example, the flow-path forming member 60A includes a plurality of C-ring-shaped members 62. The C-ring-shaped members 62 are wound around the first side wall 51. Alternatively, the C-ring-shaped members 62 may be mounted on an inner surface of the second side wall 32. The C-ring-shaped members 62 may be formed from, for example, a metal or rubber member.

The flow-path forming member 60A is formed such that, when the inside holding member 50A is provided in a cylindrical holding member 30 including the second side wall 32, a length of a flavor source outer perimeter segment L1, which is a section corresponding to an outer perimeter of a flavor source 90 in a first flow path 36 connecting the through-hole 34 and an introduction port 55 and passing between the first side wall 51 and the second side wall 32, is longer than a shortest length L2 connecting the introduction port 55 and a location where fluid flows into the flavor source outer perimeter segment L1.

In FIGS. 6 and 7, the plurality of C-ring-shaped members 62 are positioned at an area between the through-hole 34 and the introduction port 55. Alternatively, one C-ring-shaped member 62 may be positioned at the area between the through-hole 34 and the introduction port 55. Each the C-ring-shaped member 62 has an opened portion 63 opened at one point, and extends along a circumferential direction of the first side wall 51. The opened portion 63 is arranged displaced in a circumferential direction with respect to at least either of the through-hole 34 and the introduction port 55. This causes the C-ring-shaped member 62 to form the flavor source outer perimeter segment L1 along the circumferential direction between the first side wall 51 and the second side wall 32, as illustrated in FIGS. 6 and 7. Consequently, the first flow path 36 is longer than the shortest length L2 between the through-hole 34 and the introduction port 55 when there is no flow-path forming member 60A.

In the first modified example, there is used the C-ring-shaped member 62 having the opened portion 63 opened at one point. Alternatively, the flow-path forming member 60A may also include a member having an opened portion 63 opened at two or more points. Even in this case, the opened portion 63 only needs to be arranged displaced in the circumferential direction with respect to at least either of the through-hole 34 and the introduction port 55. Further, a size of the opened portion 63 is not particularly limited, and the opened portion 63 may be formed over half of the circumference or more in the circumferential direction of the first side wall 51, in some cases.

A flavor inhaler 10 may have a first separator 68A that separates the first flow path 36 and a suction port 40 (or a second flow path 38). In the first modified example, the first separator 68A may be formed by an O-ring-shaped member. The first separator 68A is provided between the first side wall 51 and the second side wall 32 on the non-ignition end E2 side from the through-hole 34 of the second side wall 32. The O-ring-shaped member as the first separator 68A completely or partially prevents a direct flow of gas into the second flow path 38 from the first flow path 36. The O-ring-shaped member may be formed from, for example, a metal or rubber member.

The flavor inhaler 10 may have a second separator 69A that prevents leakage of gas from the first flow path 36. The second separator 69A closes the opening on the ignition end E1 side of the cylindrical holding member 30, along with the inside holding member 50A and the combustion heat source 70. In the first modified example, the second separator 69A may be formed by an O-ring-shaped member. The second separator 69A is provided between the first side wall 51 and the second side wall 32, on the ignition end E1 side from the introduction port 55 of the first side wall 51. This causes the O-ring-shaped member as the second separator 69A to completely or partially prevent leakage of gas from the ignition end E1 side of the first flow path 36.

In the above-described embodiment, the separators 68A and 69A are formed from the O-ring-shaped member. Alternatively, the separators 68A and 69A may be formed from a member that is integrally formed on the first side wall 51 or the second side wall 32.

[Second Modified Example]

Figure 8:
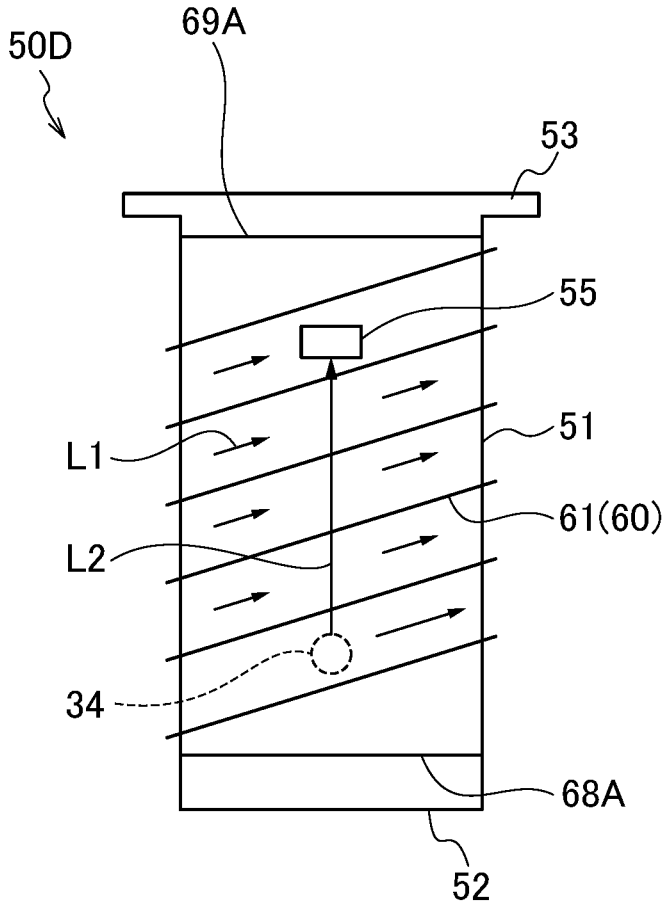
FIG. 8 is a plan view of an inside holding member and a flow-path forming member according to a second modified example.

The inside holding member and the flow-path forming member according to a second modified example are described below with reference to FIG. 8. FIG. 8 is a plan view of an inside holding member 50D and a flow-path forming member 60 according to the second modified example. In FIG. 8, a position of a through-hole 34 formed on a second side wall 32 is indicated by a dotted line for convenience.

In the second modified example, the flow-path forming member 60 includes a spiral member 61 as with that illustrated in FIG. 4. The spiral member 61 is wound around a first side wall 51. Alternatively, the spiral member 61 may be mounted on an inner surface of the second side wall 32.

There is provided a first separator 68A that separates a first flow path 36 and a suction port 40 (or a second flow path 38). The first separator 68A may be formed by an O-ring-shaped member as with the first modified example. The first separator 68A is provided between the first side wall 51 and the second side wall 32 on the non-ignition end E2 side from the through-hole 34 of the second side wall 32.

Additionally, there may be provided a second separator 69A that prevents leakage of gas from the first flow path 36. The second separator 69A may be formed by an O-ring-shaped member as with the first modified example. The second separator 69A is provided between the first side wall 51 and the second side wall 32, on the ignition end E1 side from an introduction port 55 of the first side wall 51.

[Third Modified Example]

Figure 9:
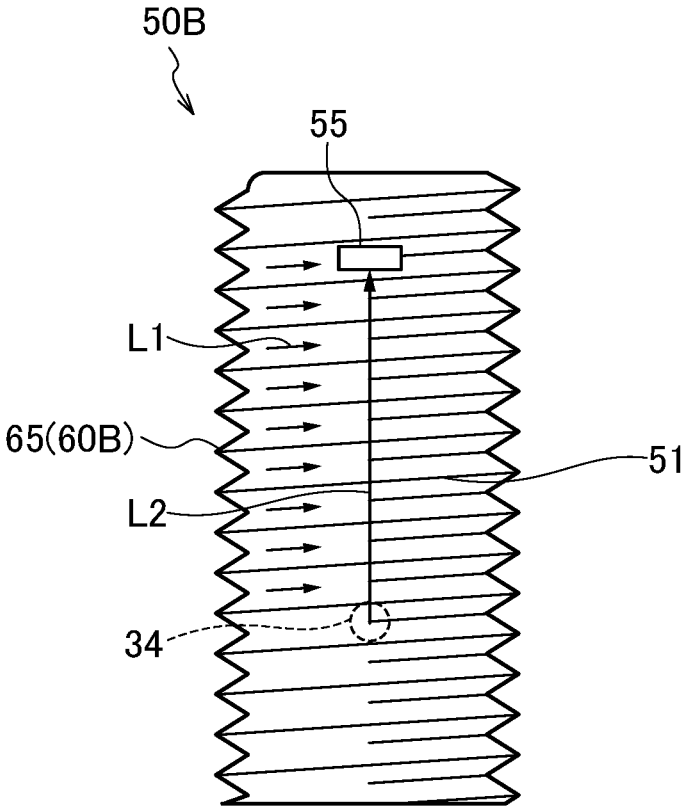
FIG. 9 is a plan view of an inside holding member and a flow-path forming member according to a third modified example.

A inside holding member and the flow-path forming member according to a third modified example are described below with reference to FIG. 9. FIG. 9 is a plan view of an inside holding member 50B and a flow-path forming member 60B according to the third modified example. In FIG. 9, a position of a through-hole 34 formed on a second side wall 32 is indicated by a dotted line for convenience.

The inside holding member 50B has a first side wall 51. The first side wall 51 is formed with the introduction port 55 that introduces external air to a flavor source 90 in the first side wall 51. The flow-path forming member 60B is formed from a protrusion and/or a groove 65 that are integrally formed on the first side wall 51. More particularly, the flow-path forming member 60A is formed from the spiral-shaped protrusion and/or groove 65 that are integrally formed on the first side wall 51.

The flow-path forming member 60B is formed such that, when the inside holding member 50B is provided in a cylindrical holding member 30 including the second side wall 32, a length of a flavor source outer perimeter segment L1, which is a section corresponding to an outer perimeter of the flavor source 90 in the first flow path 36 connecting the through-hole 34 and the introduction port 55 and passing between the first side wall 51 and the second side wall 32, is longer than a shortest length L2 connecting the introduction port 55 and a location where fluid flows into the flavor source outer perimeter segment L1.

In the third modified example, the spiral-shaped protrusion and/or groove 65 are positioned at an area between the through-hole 34 and the introduction port 55. Between the second side wall 32, and the spiral-shaped protrusion and/or groove 65, a spiral gap (flow path) is formed. Consequently, the length L1 of the first flow path 36 is longer than the shortest length L2 between the through-hole 34 and the introduction port 55 when there is no flow-path forming member 60B.

[Fourth Modified Example]

Figure 10:
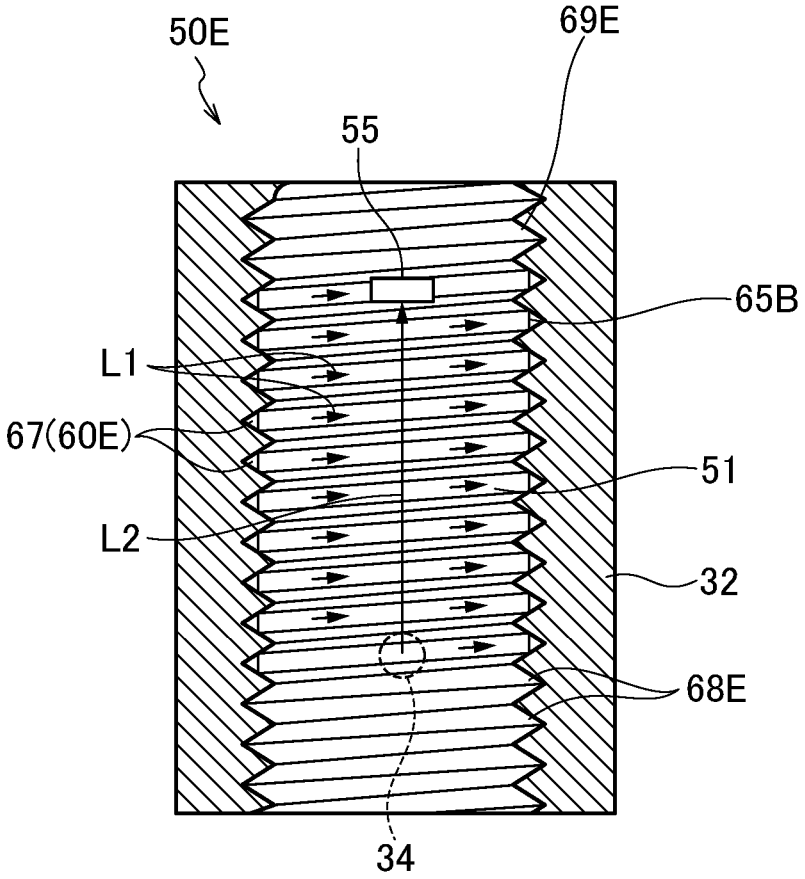
FIG. 10 is a view of an inside holding member and a flow-path forming member according to a fourth modified example.

An inside holding member and the flow-path forming member according to a fourth modified example are described below with reference to FIG. 10. FIG. 10 is a plan view of an inside holding member 50E and a flow-path forming member 60E according to the fourth modified example. In FIG. 10, a position of a through-hole 34 formed on a second side wall 32 is indicated by a dotted line for convenience.

The inside holding member 50E is inserted into the second side wall 32 of a cylindrical holding member 30. In FIG. 10, the second side wall 32 is illustrated in a cross-sectional view. The inside holding member 50E has a first side wall 51 formed with a spiral-shaped protrusion and/or groove. The first side wall 51 is formed with an introduction port 55 that introduces external air to a flavor source 90 in the first side wall 51. The flow-path forming member 60E is formed from a groove 67 integrally formed on the second side wall 32.

To be more precise, the second side wall 32 is formed with the spiral groove 67. Additionally, the first side wall 51 of the inside holding member 50E is formed with a spiral-shaped protrusion matching a position of the spiral groove 67. Except near both sides of the first side wall 51, a tip of the spiral-shaped protrusion formed on the first side wall 51 is cut off. Between a tip 65B of the cut-off protrusion and the spiral groove 67 formed on the second side wall 32, a first flow path 36 is formed. The first flow path 36 extends spirally. Consequently, the length L1 of the first flow path 36 is longer than the shortest length L2 between the through-hole 34 and the introduction port 55 when there is no flow-path forming member 60B.

The inside holding member 50E is provided with a first separator 68E that separates the first flow path 36 and a suction port 40 (or the second flow path 38). The first separator 68E may be formed by the spiral-shaped protrusion formed on the first side wall 51. The first separator 68E may be provided on the non-ignition end E2 side from the through-hole 34. A tip of the spiral-shaped protrusion as the first separator 68E may not be cut off, and adhere to the groove of the second side wall 32.

The inside holding member 50E is provided with a second separator 69E that prevents leakage of gas from the first flow path 36. The second separator 69E closes an opening on the ignition end E1 side of the cylindrical holding member 30, along with the inside holding member 50E and a combustion heat source 70. The second separator 69E may be formed by the spiral-shaped protrusion formed on the first side wall 51. The second separator 69E may be provided on the ignition end E1 side from the introduction port 55. A tip of the spiral-shaped protrusion as the second separator 69E may not be cut off, and adhere to the groove 67 of the second side wall 32.

According to the fourth modified example, by screwing the inside holding member 50E into the cylindrical holding member 30, the spiral first flow path 36 and the separators 68E and 69E can be simultaneously formed between the inside holding member 50E and the cylindrical holding member 30. Moreover, since the spiral-shaped protrusion and groove are engaged with each other, the inside holding member 50E is firmly retained.

[Second Embodiment]

Figure 11:
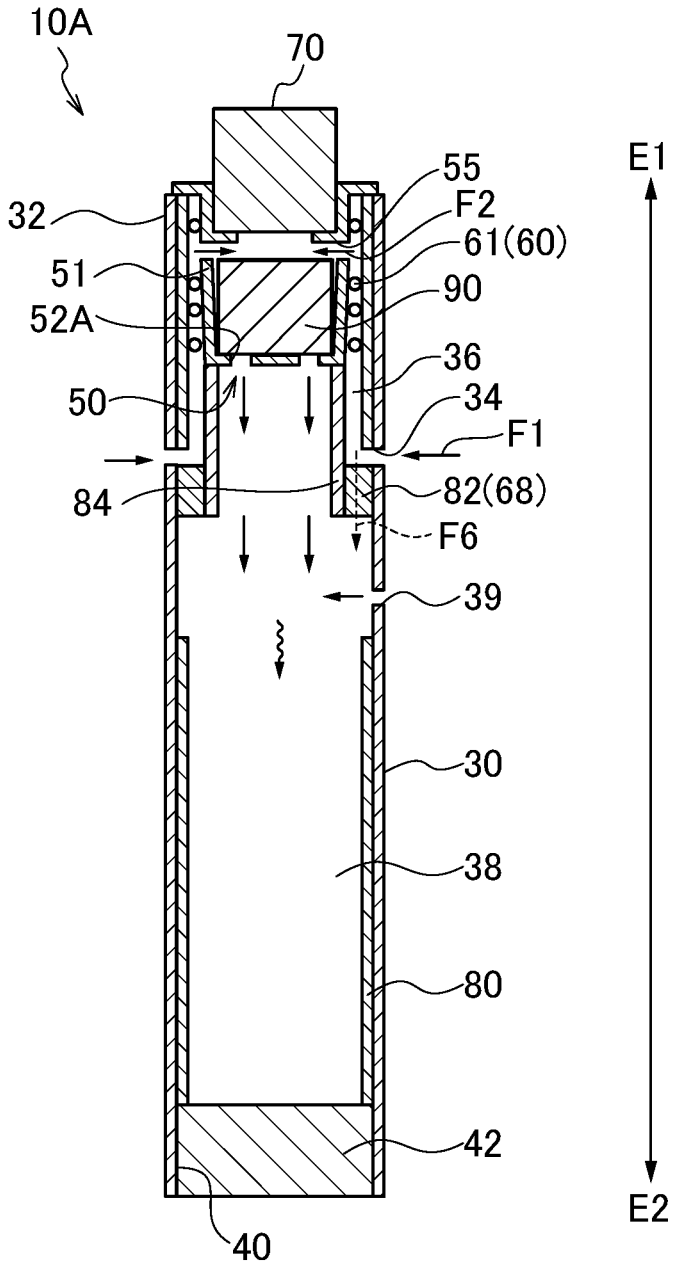
FIG. 11 is a cross-sectional view of a flavor inhaler according to a second embodiment.

A flavor inhaler 10A according to a second embodiment is described below with reference to FIG. 11. The same reference numerals are given to the same configurations as those of the first embodiment. Differences from the first embodiment are mainly described below.

In the second embodiment, a through-hole 34 formed to a cylindrical holding member 30 is provided on a non-ignition end side E2 from an end part on the non-ignition end E2 side of a flavor source 90. A first flow path 36 extends from the through-hole 34 toward an ignition end E1 side. Inside the cylindrical holding member 30, a pipe member 84 is provided. The pipe member 84 separates between the first flow path 36 and a second flow path 38, and may extend from a position of the through-hole 34 to a first side wall 51. The first flow path 36 reaches an introduction port 55 passing between a first side wall 51 of an inside holding member 50 and a second side wall 32 of the cylindrical holding member 30.

A section, of the first flow path 36, around the through-hole 34 may be adjacent to the second flow path 38 via a separator 68. The separator 68 includes a resistance member 82 that fills a gap directly connecting the first flow path 36 and the second flow path 38. The resistance member 82 does not completely fluidly cut off between the first flow path 36 and the second flow path 38, but increases a fluid resistance of a path directly entering into the second flow path 38 from the first flow path 36.

The fluid resistance of the path directly entering into the second flow path 38 from the first flow path 36 through the resistance member 82 (see arrow F6 in FIG. 11), is preferably larger than a fluid resistance of a path reaching the second flow path from the first flow path 36 through the flavor source 90. In other words, the separator 68 only needs to be configured such that the fluid resistance of the path passing the flavor source 90 is smaller than the fluid resistance of the path not passing the flavor source 90, in paths connecting the first flow path 36 and the second flow path 38. This allows most of air flowing into the first flow path 36 to be introduced to the flavor source 90.

As long as the separator 68 is configured such that the fluid resistance of the path passing the flavor source 90 is smaller than the fluid resistance of the path not passing the flavor source 90 in the paths connecting the first flow path 36 and the second flow path 38, the separator 68 may reach a part of the first flow path 36 and/or the through-hole 34.

As described in the second embodiment, there may be provided a plurality of paths connecting the first flow path 36 and the second flow path 38. In this case, in the paths connecting the first flow path 36 with the second flow path 38, the fluid resistance of the path passing the flavor source 90 is preferably the smallest.

In the second embodiment, the first flow path 36 and the second flow path 38 are not fluidly completely cut off from each other. Alternatively, it is preferable that the separator 68 fluidly completely cuts off the first flow path 36 and the second flow path 38 from each other.

[Third Embodiment]

Figure 12:
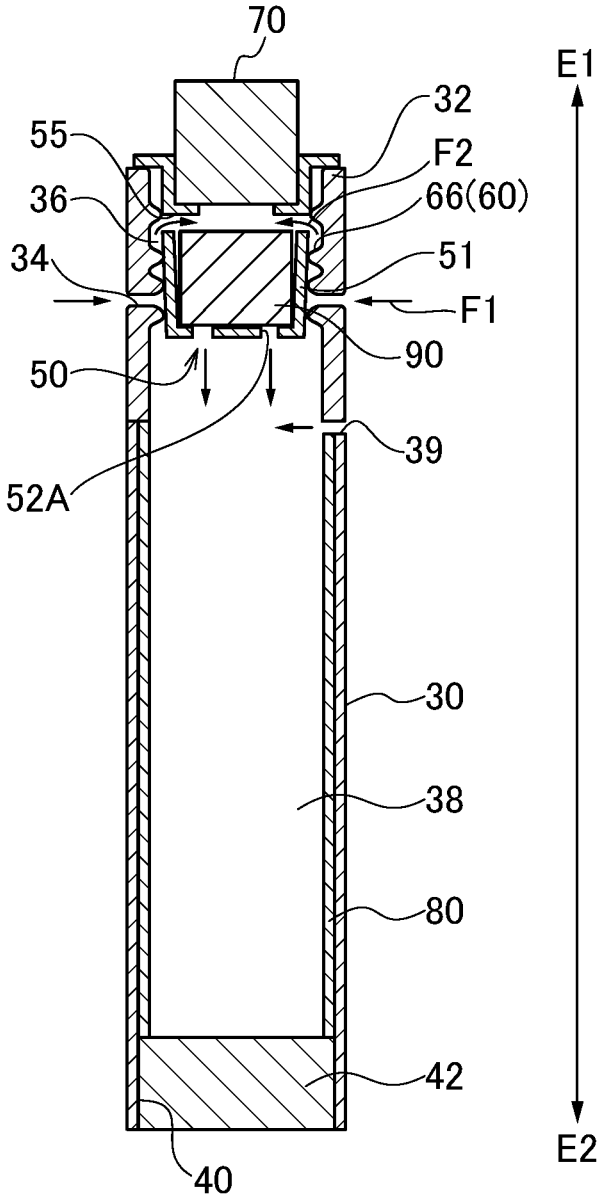
FIG. 12 is a cross-sectional view of a flavor inhaler according to a third embodiment.

A flavor inhaler according to a third embodiment is described below with reference to FIG. 12. The same reference numerals are given to the same configurations as those of the first embodiment. Differences from the first embodiment are mainly described below.

In the third embodiment, a flow-path forming member 60 between a first side wall 51 of an inside holding member 50 and a second side wall 32 of a cylindrical holding member 30 is formed from a protrusion or groove 66 integrally formed on an inner surface of the second side wall 32. The protrusion or groove 66 integrally formed on the inner surface of the second side wall 32 may have a spiral shape, for example. Even in this case, a length of a flavor source outer perimeter segment, which is a section corresponding to an outer perimeter of a flavor source 90 in a first flow path 36, can be longer than a shortest length connecting an introduction port 55 and a location where fluid flows into the flavor source outer perimeter segment.

When the cylindrical holding member 30 has a thermal conductor facing the first flow path 36, a protrusion or a groove as a flow-path forming member may simply be formed on an inner surface of the thermal conductor.

[Fourth Embodiment]

Figure 13:
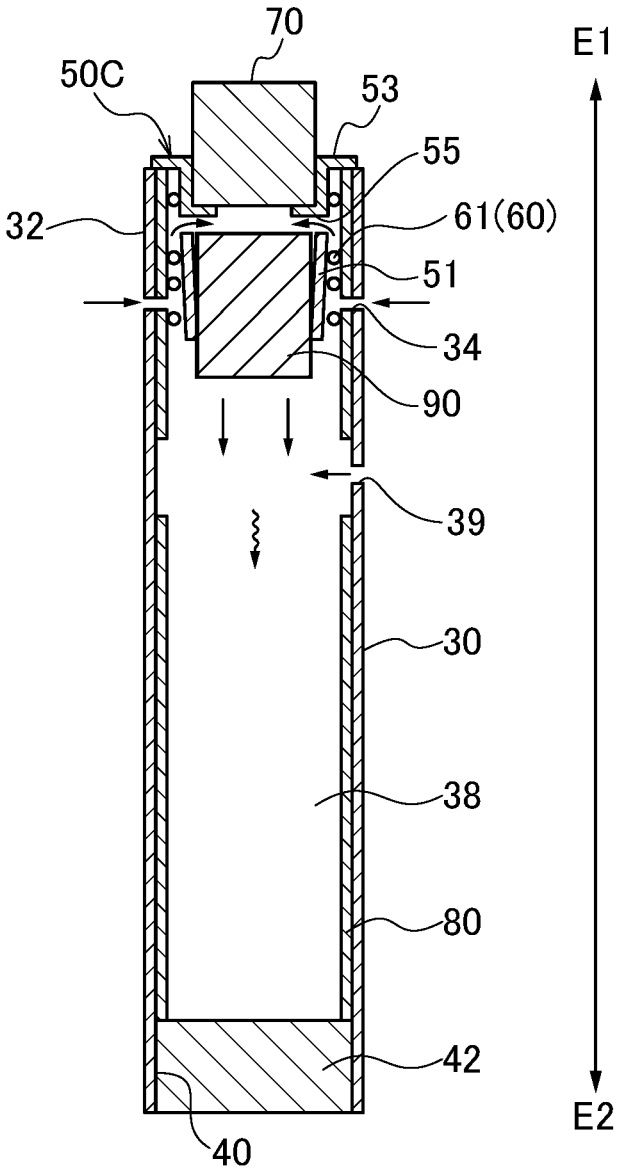
FIG. 13 is a cross-sectional view of a flavor inhaler according to a fourth embodiment.

A flavor inhaler according to a fourth embodiment is described below with reference to FIG. 13. The same reference numerals are given to the same configurations as those of the first embodiment. Differences from the first embodiment are mainly described below.

In the fourth embodiment, a shape of an inside holding member 50C is different from a shape of the inside holding member illustrated in FIGS. 4 and 5. To be more precise, the inside holding member 50C does not have a bottom part illustrated in FIGS. 4 and 5. A first side wall 51 of the inside holding member 50C may have a tapered shape inclined toward a center and toward the non-ignition end E2 side. A flavor source 90 is also inclined toward the center and toward the non-ignition end E2 side. This allows the inside holding member 50C to retain the flavor source 90 even without the bottom part.

Additionally, since the first side wall 51 of the inside holding member 50C has the tapered shape inclined toward the center and toward the non-ignition end E2 side, the inside holding member 50C is easily inserted into a cylindrical holding member 30.

Moreover, the first side wall 51 of the inside holding members 50, 50A, and 50D illustrated in FIGS. 4 to 8 may also have the tapered shape as described in this embodiment.

[Fifth Embodiment]

Figure 14:
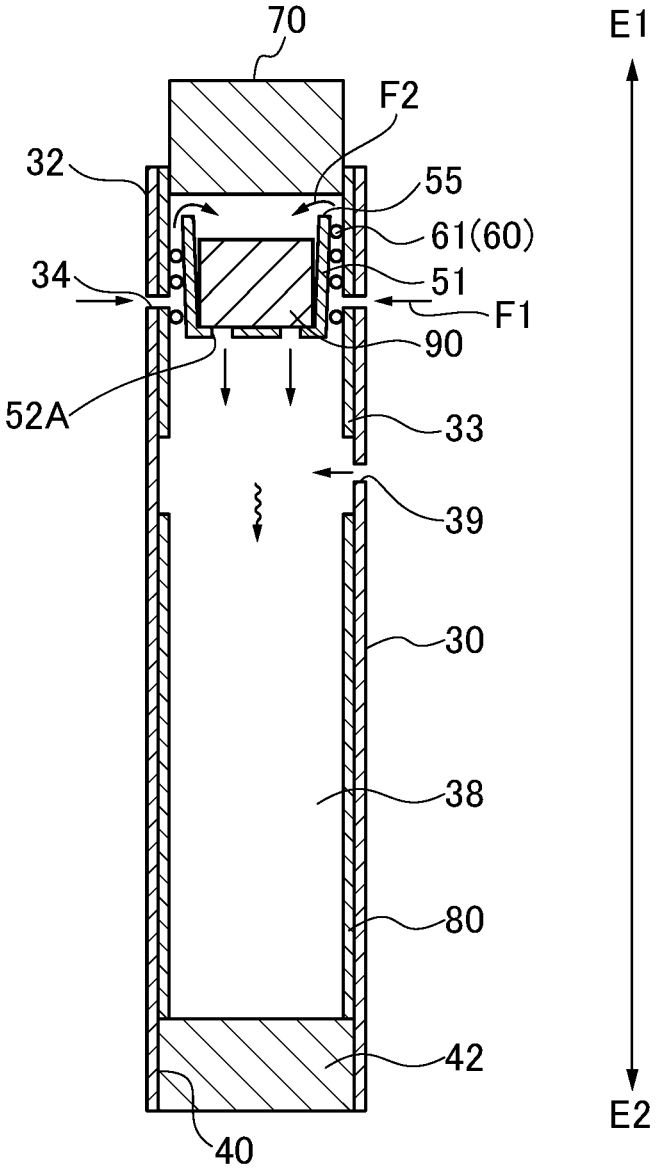
FIG. 14 is a cross-sectional view of a flavor inhaler according to a fifth embodiment.

A flavor inhaler according to a fifth embodiment is described below with reference to FIG. 14. The same reference numerals are given to the same configurations as those of the first embodiment. Differences from the first embodiment are mainly described below.

In a fifth embodiment, an introduction port 55 that allows fluid to flow to a flavor source 90 from a first flow path is formed by an opening on one end side of a first side wall 51 of an inside holding member. More specifically, fluid in the first flow path flows into a space provided with the flavor source 90 inside the first side wall 51, from a gap between the inside holding member and a combustion heat source 70. Thus, the "introduction port 55" may be a concept that includes not only a hole formed on the cylindrical first side wall 51, but also an opening at an end part of the cylindrical first side wall 51. In this case, the hole does not need to be formed on the first side wall 51.

In the fifth embodiment, the inside holding member retains the flavor source 90, but does not retain the combustion heat source 70. Thus, the inside holding member does not need to retain the combustion heat source 70. In this case, the first side wall does not need to be formed with a hook section that locks to the combustion heat source 70.

[Other Embodiments]

Although the present invention has been described with the above-described embodiments, the descriptions and drawings forming a part of the disclosure should not be construed as limiting the present invention. From this disclosure, various alternative embodiments, examples, and operation techniques will be apparent to those skilled in the art.

The features described in a plurality of embodiments and modified examples described above can be combined as possible. For example, various combinations of the plurality of flow-path forming members 60, 60A, and 60B and the separators 68, 68A, 69, and 69A described above are possible.

INDUSTRIAL APPLICABILITY

According to an embodiment, there can be provided a flavor inhaler and an inside holding member that can prevent flavor from flowing out from a through-hole through a first flow path from a flavor source.

The invention claimed is:

1. A flavor inhaler comprising:

a cylindrical holding member extending from an ignition end to a non-ignition end;

a combustion heat source provided at the ignition end;

a flavor source provided on the non-ignition end side with respect to the combustion heat source;

an inside holding member that is provided into the cylindrical holding member, and retains at least the flavor source; and an introduction port that introduces air to the flavor source, wherein the inside holding member has a first side wall having a cylindrical shape to surround at least a part of the flavor source;

the cylindrical holding member has a second side wall having a cylindrical shape to surround the first side wall;

the introduction port is formed on the first side wall;

the second side wall has a through-hole that is fluidly coupled to external air;

the flavor inhaler further comprises a first flow path and a second flow path, the first flow path connecting the through-hole and the introduction port each other and passing between the first side wall and the second side wall, the second flow path connecting the flavor source and a suction port provided at the non-ignition end of the cylindrical holding member to suck flavor generated at the flavor source; and a flow-path forming member is formed such that a length of a flavor source outer perimeter segment that is a section corresponding an outer perimeter of the flavor source, in the first flow path, is longer than a shortest length connecting the introduction port and a location where the external air from the through-hole flows into the flavor source outer perimeter segment.

2. The flavor inhaler according to claim 1, wherein a fluid resistance of a path passing the flavor source is smaller than a fluid resistance of a path not passing the flavor source, in paths connecting the first flow path and the second flow path.

3. The flavor inhaler according to claim 1, wherein an opening on the ignition end side of the cylindrical holding member is closed by the combustion heat source.

4. The flavor inhaler according to claim 1, wherein the through-hole is provided on the ignition end side from an end part of the non-ignition end side of the flavor source.

5. The flavor inhaler according to claim 1, wherein the introduction port is provided on the ignition end side from the through-hole, and the first flow path is provided only on the ignition end side from the end part on the non-ignition end side of the flavor source.

6. The flavor inhaler according to claim 1, further comprising a cavity downstream of the flavor source defined by the cylindrical holding member, the cavity diffusing flavor, wherein the cavity forms the second flow path.

7. The flavor inhaler according to claim 1, wherein the flow-path forming member has at least one member provided between the first side wall and the second side wall.

8. The flavor inhaler according to claim 1, wherein the flow-path forming member includes a spiral member.

9. The flavor inhaler according to claim 1, wherein the flow-path forming member includes a spiral member wound around the first side wall.

10. The flavor inhaler according to claim 1, wherein the flow-path forming member includes a member that has an opened portion opened at least at one point and that extends along a circumferential direction of the first side wall, and the opened portion at least at one point is displaced in the circumferential direction with respect to at least either of the through-hole and the introduction port.

11. The flavor inhaler according to claim 1, wherein the flow-path forming member has a protrusion or a groove integrally formed on an outer surface of the first side wall or on an inner surface of the second side wall.

12. The flavor inhaler according to claim 11, wherein the protrusion or the groove is formed into a spiral shape.

13. The flavor inhaler according to claim 1, further comprising a separator that divides the first flow path and the suction port.

14. The flavor inhaler according to claim 13, wherein the separator extends in a circumferential direction of the first side wall, between the first side wall and the second side wall.

15. The flavor inhaler according to claim 1, wherein the inside holding member is configured to retain the combustion heat source and the flavor source;

the inside holding member has a hook section that protrudes toward inside the first side wall and locks the combustion heat source; and the introduction port is formed on the non-ignition end side with respect to a contact point of the hook section and the combustion heat source, of the first side wall.

16. The flavor inhaler according to claim 15, wherein the introduction port is adjacent to the non-ignition end side with respect to the contact point of the hook section and the combustion heat source.

17. The flavor inhaler according to claim 1, wherein the first side wall has a tapered shape that enters into inside of the first side wall toward the non-ignition end side from the ignition end side.

18. The flavor inhaler according to claim 1, wherein the inside holding member has a bottom part that supports an end surface on the non-ignition end side of the flavor source;

an air hole is formed at a section on the non-ignition end side of the inside holding member; and the introduction port is provided on the ignition end side from the flavor source or around the flavor source.

19. The flavor inhaler according to claim 1, wherein the second side wall has a thermal conductor that covers at least a part of the first side wall and that extends on the non-ignition end side from the first side wall.

20. The flavor inhaler according to claim 1, wherein the inside holding member is integrally formed by a thermal conductor.

21. An inside holding member that is used for a flavor inhaler including a combustion heat source and a flavor source and that retains at least the flavor source, the inside holding member comprising:

a first side wall having a cylindrical shape to surround at least a part of the flavor source;

an introduction port that introduces air into inside of the first side wall, the introduction port being formed on the first side wall; and a flow-path forming member formed such that, when the inside holding member is provided in a cylindrical holding member including a second side wall having a through-hole that is fluidly coupled to external air, a length of a flavor source outer perimeter segment that is a section corresponding to an outer perimeter of the flavor source, in a flow path connecting the through-hole and the introduction port and passing between the first side wall and the second side wall, is longer than a shortest length connecting the introduction port and a location where the external air from the through-hole flows into the flavor source outer perimeter segment.

* * * * *